US008444148B1

(12) United States Patent
Tseng

(10) Patent No.: US 8,444,148 B1
(45) Date of Patent: May 21, 2013

(54) AUTOMATIC POKER MACHINE

(76) Inventor: Tzu-Hsiang Tseng, Taichung (TW)

( * ) Notice: Subject to any disclaimer, the term of this patent is extended or adjusted under 35 U.S.C. 154(b) by 28 days.

(21) Appl. No.: 13/282,583

(22) Filed: Oct. 27, 2011

(51) Int. Cl.
*A63F 1/12* (2006.01)

(52) U.S. Cl.
USPC ..... 273/149 R; 273/309

(58) Field of Classification Search
USPC ..... 273/149 R, 149 P, 309
See application file for complete search history.

(56) References Cited

U.S. PATENT DOCUMENTS

| | | | | |
|---|---|---|---|---|
| 6,361,044 | B1 * | 3/2002 | Block et al. | 273/149 R |
| 7,300,056 | B2 * | 11/2007 | Gioia et al. | 273/149 R |
| 7,392,936 | B1 * | 7/2008 | Green et al. | 235/379 |
| 2003/0151194 | A1 * | 8/2003 | Hessing et al. | 273/149 R |
| 2007/0090595 | A1 * | 4/2007 | Csikos | 273/149 R |

* cited by examiner

*Primary Examiner* — Benjamin Layno
(74) *Attorney, Agent, or Firm* — Rosenberg, Klein & Lee

(57) ABSTRACT

An automatic poker machine includes a mechanical arm using a suction disk for picking up a poker card, a video recognition device adapted for recognizing the card suit and card value of the poker card carried by the mechanical arm, a display screen for displaying the card suit and card value of each recognized poker card and two card shufflers alternatively used for shuffling poker cards.

1 Claim, 4 Drawing Sheets

AUTOMATIC POKER MACHINE

BACKGROUND OF THE INVENTION

1. Field of the Invention

The present invention relates to poker machines and more particularly, to an automatic poker machine, which consists of a mechanical arm, a card shuffle and a video recognition device for collecting poker cards, shuffling poker cards, dispensing poker cards, recognizing poker cards and displaying poker cards fully automatically.

2. Description of the Related Art

A card game (poker game) is a game using playing cards as the primary device with which the game is played. When playing a card game (poker game), playing cards are distributed among players manually by the dealer or automatically by an automatic card dispenser. When one pack of playing cards (poker cards) is shuffled once, the dealer needs to pick up the primarily shuffled playing cards (poker cards) from the card shuffler and then insert the primarily shuffled playing cards (poker cards) into the card shuffler again for a secondary shuffling. Therefore, these card shufflers require much labor.

SUMMARY OF THE INVENTION

The present invention has been accomplished under the circumstances in view. It is the main object of the present invention to provide an automatic poker machine, which can collect playing cards, shuffle playing cards, dispense playing cards, recognize playing cards and display playing cards fully automatically, saving much labor and avoiding shuffling trick.

To achieve this and other objects of the present invention, an automatic porker machine comprises a mechanical arm, a video recognition device, a display screen, and two card shufflers. The mechanical arm uses a suction disk for picking up a poker card. The video recognition device is adapted for recognizing the card suit and card value of the poker card carried by the mechanical arm. The display screen is adapted for displaying the card suit and card value of each recognized poker card. The two card shufflers are alternatively used for shuffling poker cards.

DETAILED DESCRIPTION OF THE PREFERRED EMBODIMENT

Figure 1:
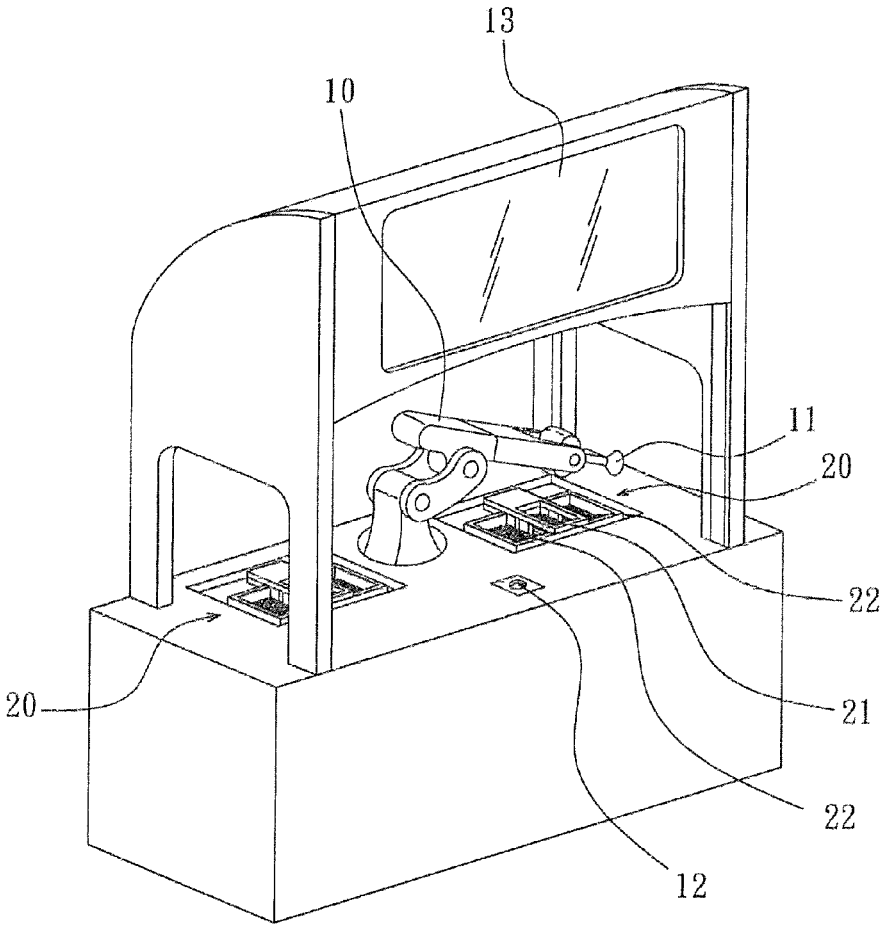
FIG. 1 is an elevational view of an automatic poker machine in accordance with the present invention.
Figure 2:
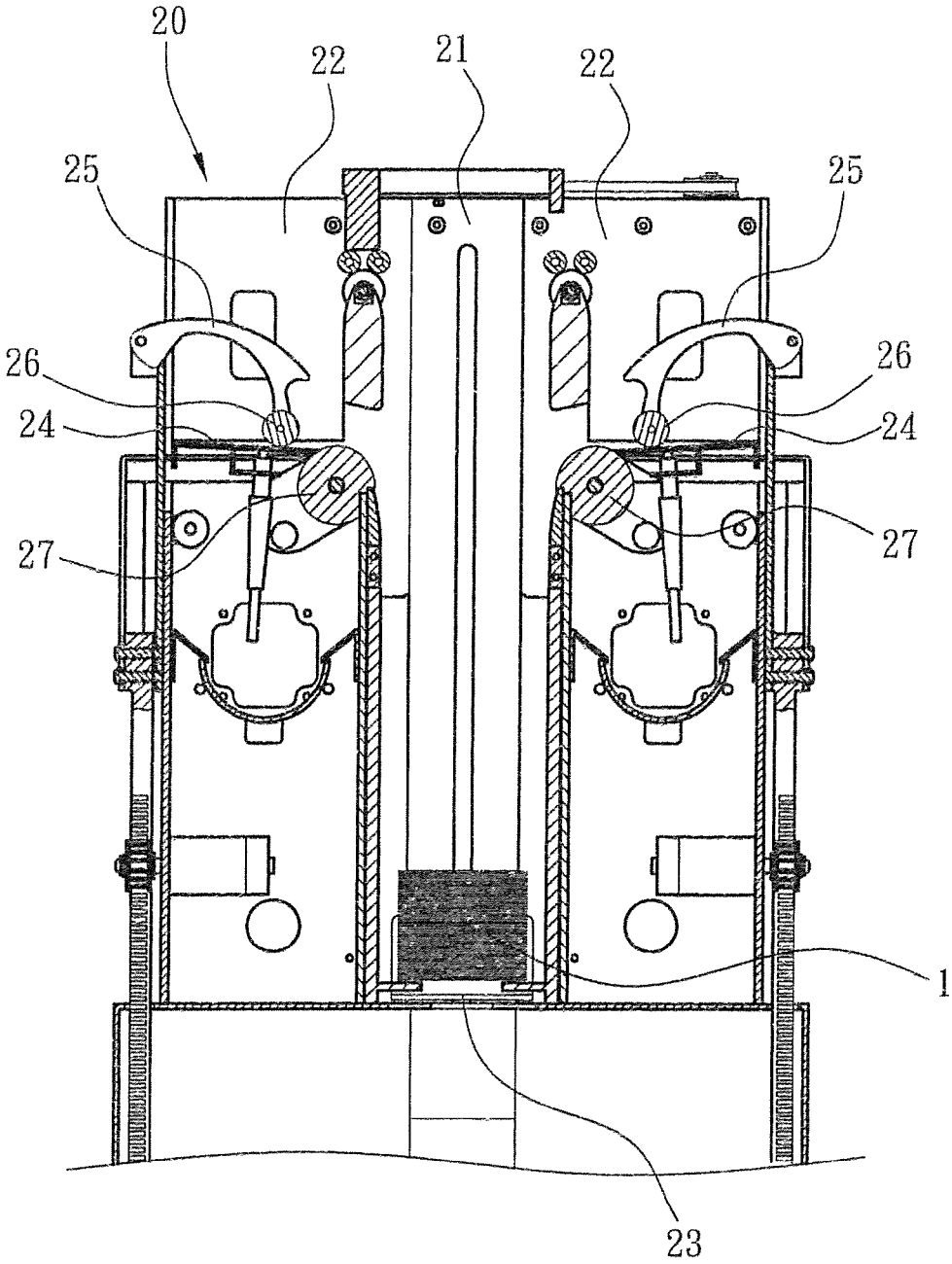
FIG. 2 is a front view of a part of the present invention illustrating the structure of one card shuffler.
Figure 3:
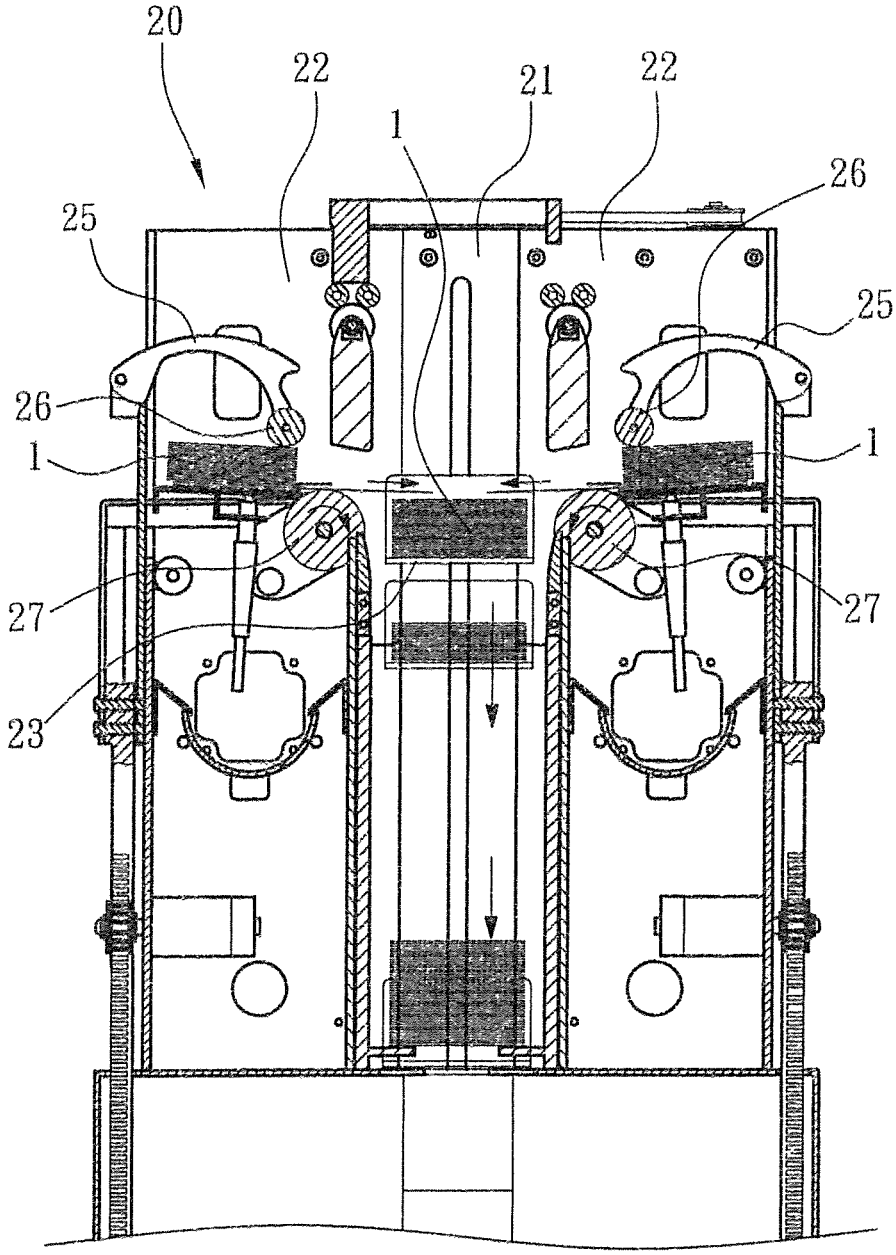
FIG. 3 corresponds to FIG. 2, illustrating a status of operation of the card shuffler.

Referring to FIGS. 1-3, an automatic poker machine in accordance with the present invention is shown comprising a mechanical arm 10, a video recognition device 12, a display screen 13, and two card shufflers 20.

The mechanical arm 10 comprises a suction disk 11 for picking up poker cards 1 individually.

Each card shuffler 20 comprises a card-dispensing slot 21, two card-collecting slots 22 at two opposite lateral sides of the card-dispensing slot 21, two card carriers 24 respectively set in the two card-collecting slots 22 for holding poker cards 1, two presser arms 25 respectively pivotally disposed in the card-collecting slots 22 above the respective card carriers 24, two impression rollers 26 respectively pivotally mounted at the free ends of the presser arms 25 in the card-collecting slots 22 for holding poker cards 1 on the respective card carriers 24, two motor-driven card-transfer wheels 27 respectively controllable to transfer poker cards from the card-collecting slots 22 into the card-dispensing slot 21, and a lifting card holder 23 vertically movably mounted in the card-dispensing slot 21 and adapted for receiving poker cards 1 transferred by one of the motor-driven card-transfer wheels 27 from one of the two card-collecting slots 22.

Figure 4:
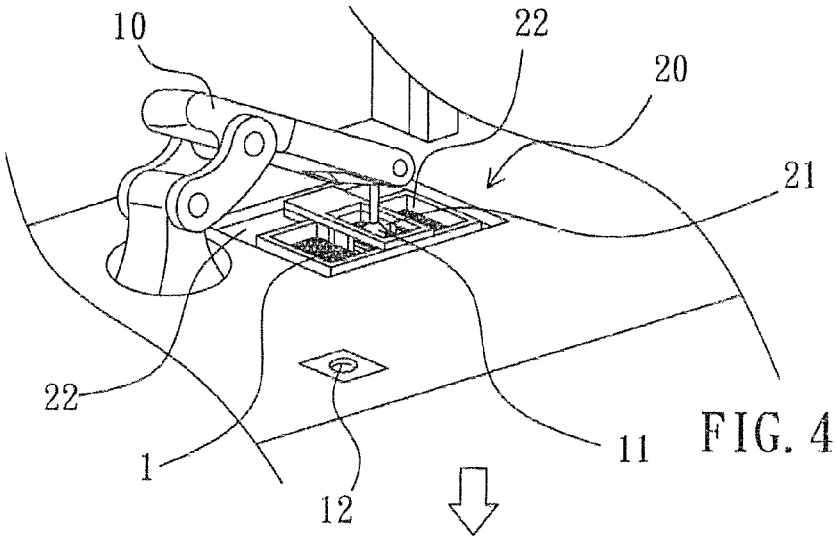
FIG. 4 is a schematic drawing of the present invention, illustrating a card-dispensing operation of the automatic poker machine.
Figure 5:
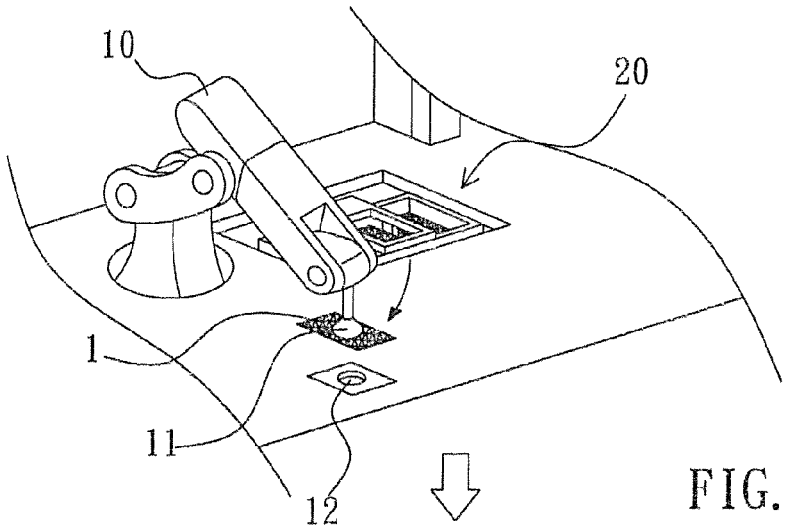
FIG. 5 is a schematic drawing of the present invention, illustrating a card-recognition operation of the automatic poker machine.
Figure 6:
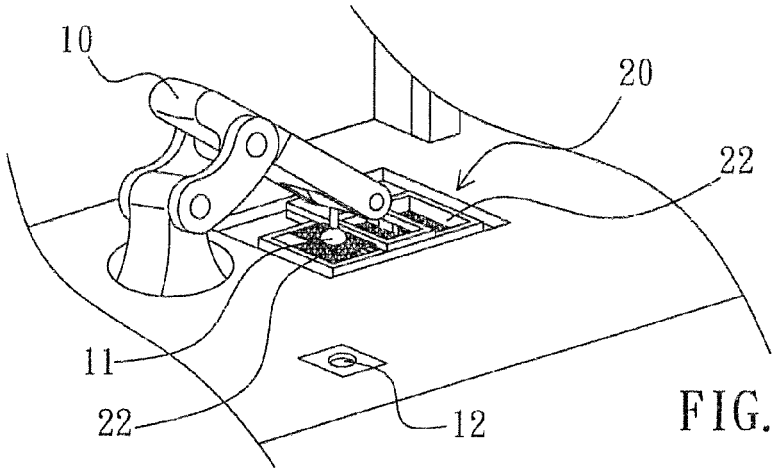
FIG. 6 is a schematic drawing of the present invention, illustrating a card-collection operation of the automatic poker machine.

When dispensing poker cards, as shown in FIG. 4, the mechanical arm 10 is controlled to move the suction disk 11 to the card-dispensing slot 21 of one card shuffler 20 and then to pick up one poker card 1 from the lifting card holder 23 for enabling the video recognition device 12 to recognize the card suit and card value of the poker card 1 (see FIG. 5) for display on the display screen 13. Thereafter, the mechanical arm 10 carries the duly displayed poker card 1 to one card-collecting slot 22 (see FIG. 6) and then release the suction force from the suction disk 11 for enabling the duly displayed poker card 1 to fall to the card-collecting slot 22, finishing one cycle of card-dispensing, card-displaying and card-collecting actions, This operation procedure is repeated again and again until all the desired number of poker cards has been distributed to the players. When the poker cards in one card shuffler 20 has been dealt, the mechanical arm 10 is controllable to pick up poker cards from the other card shuffler 30. At this time, the primarily served card shuffler 20 is controlled to shuffle porker cards for next service. Thus, when one card shuffler 20 shufflers porker cards, the other card shuffler 20 is controlled to dispense porker cards, enabling the poker game to be continued without interruption.

The shuffling operation and effects of the present invention are outlined hereinafter. Collected poker cards 1 are received by the card carriers 24 in the card-collecting slots 22. When poker cards have been dealt, card shuffling is started. As this time, as shown in FIG. 3, the two motor-driven card-transfer wheels 27 are respectively controlled to transfer poker cards from the card-collecting slots 22 into the card-dispensing slot 21, and the lifting card holder 23 is moved vertically in the card-dispensing slot 21 for receiving poker cards 1 transferred by the motor-driven card-transfer wheels 27 from the two card-collecting slots 22. Therefore, when one card shuffler 20 shufflers porker cards, the other card shuffler 20 is controlled to dispense porker cards, enabling the poker game to be continued without interruption.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An automatic poker machine, comprising:

a mechanical arm comprising a suction disk for picking up a poker card;

a video recognition device adapted for recognizing the card suit and card value of the poker card carried by said mechanical arm;

a display screen for displaying the card suit and card value of each recognized poker card; and two card shufflers for shuffling poker cards, each said card shuffler comprising a card-dispensing slot, two card-collecting slots at two opposite lateral sides of said card-dispensing slot, two card carriers respectively set in said two card-collecting slots for holding poker cards, two presser arms respectively pivotally disposed in said card-collecting slots above the respective card carriers, two impression rollers respectively pivotally mounted at respective free ends of said presser arms in said card-collecting slots for holding poker cards on the respective card carriers, two motor-driven card-transfer wheels respectively controllable to transfer poker cards from said card-collecting slots into said card-dispensing slot, and a lifting card holder vertically movably mounted in said card-dispensing slot and adapted for receiving poker cards transferred by one of said motor-driven card-transfer wheels from one of said two card-collecting slots.

* * * * *